US005889457A

United States Patent [19]

Hsu et al.

[11] Patent Number: 5,889,457

[45] Date of Patent: Mar. 30, 1999

[54] OVERLOAD PROTECTIVE CIRCUIT BREAKER SWITCH

[76] Inventors: Cheng-Chao Hsu; Hsien-Wen Hung; Kuang-Tsan Hung; Hui-Fang Hung, all of No. 11, Lane 295, Ching Yun Rd., Tu Cheng, Taipei Hsien, Taiwan

[21] Appl. No.: 845,264

[22] Filed: Apr. 28, 1997

[51] Int. Cl.[6] ..... H01H 71/16

[52] U.S. Cl. ..... 337/59; 337/60; 337/52; 337/70

[58] Field of Search ..... 337/59, 52, 66, 337/68, 79, 72, 75, 36, 37, 2, 53, 70

[56] References Cited

U.S. PATENT DOCUMENTS

| | | | |
|---|---|---|---|
| 4,528,538 | 7/1985 | Anderson | 337/43 |
| 4,833,439 | 5/1989 | Bowden et al. | 337/68 |
| 5,223,813 | 6/1993 | Camberleng et al. | 337/66 |
| 5,453,725 | 9/1995 | You et al. | 337/59 X |
| 5,539,371 | 7/1996 | Yu | 337/79 X |
| 5,694,106 | 12/1997 | Wang | 337/79 |

*Primary Examiner*—Leo P. Picard

*Assistant Examiner*—Jayprakash N. Gandhi

*Attorney, Agent, or Firm*—Bacon & Thomas

[57] ABSTRACT

An overload protective circuit breaker switch including: a first fixed contact and a second fixed contact adapted to connect an electric appliance to power supply; a movable contact adapted to form with the first fixed contact and the second fixed contact a normal open contact; an actuator controlled by the user to turn about an axis; a lever coupled to and turned with the actuator, the lever being turned about a first bearing point, when the overload protective circuit breaker switch is not at an overload status, to move the movable contact between a normal open contact position in which the movable contact form with the first fixed contact and the second fixed contact a normal open contact, and a normal close contact position in which the movable contact form with the first fixed contact and the second fixed contact a normal close contact; and a release mechanism adapted to move the lever, the release mechanism releasing the lever from the first bearing point to a second bearing point upon an overload, causing the lever to release the movable contact and to let the movable contact return to the normal open contact status.

4 Claims, 4 Drawing Sheets

OVERLOAD PROTECTIVE CIRCUIT BREAKER SWITCH

BACKGROUND OF THE INVENTION

The present invention relates to an overload protective circuit breaker switch, and more particularly to such an overload protective circuit breaker switch that is specifically designed for use in a small electric appliance to automatically cut off power supply in case of an overload.

Using a fuse or fuseless circuit breaker to protect an electric appliance against overload has been well known. Various circuit breaker means have been disclosed. Exemplars are seen in U.S. Pat. No. 5,223,813, entitled "Circuit breaker rocker actuator switch"; U.S. Pat. Nos. 4,528,538; 4,833,439, etc. These disclosures teach the installation of circuit breaker means with bimetal contact means which automatically cuts off power supply in case of an overload or overcurrent. These circuit breaker means are functional, however they are complicated in structure.

SUMMARY OF THE INVENTION

It is the main object of the present invention to provide an overload protective circuit breaker which immediately cuts off power supply from the electric appliance upon an overload. It is another object of the present invention to provide an overload protective circuit breaker which automatically breaks the circuit when it is switched on upon an overcurrent. It is still another object of the present invention to provide an overload protective circuit breaker switch which has a simple structure, and is easy and inexpensive to manufacture. It is still another object of the present invention to provide an overload protective circuit breaker switch which is compact, and can be independently used in an electric appliance to automatically break the circuit upon an overload. It is still another object of the present invention to provide an overload protective circuit breaker switch which can be conveniently adjusted to change its trip-off time upon an overload.

DETAILED DESCRIPTION OF THE PREFERRED EMBODIMENT

Figure 1:
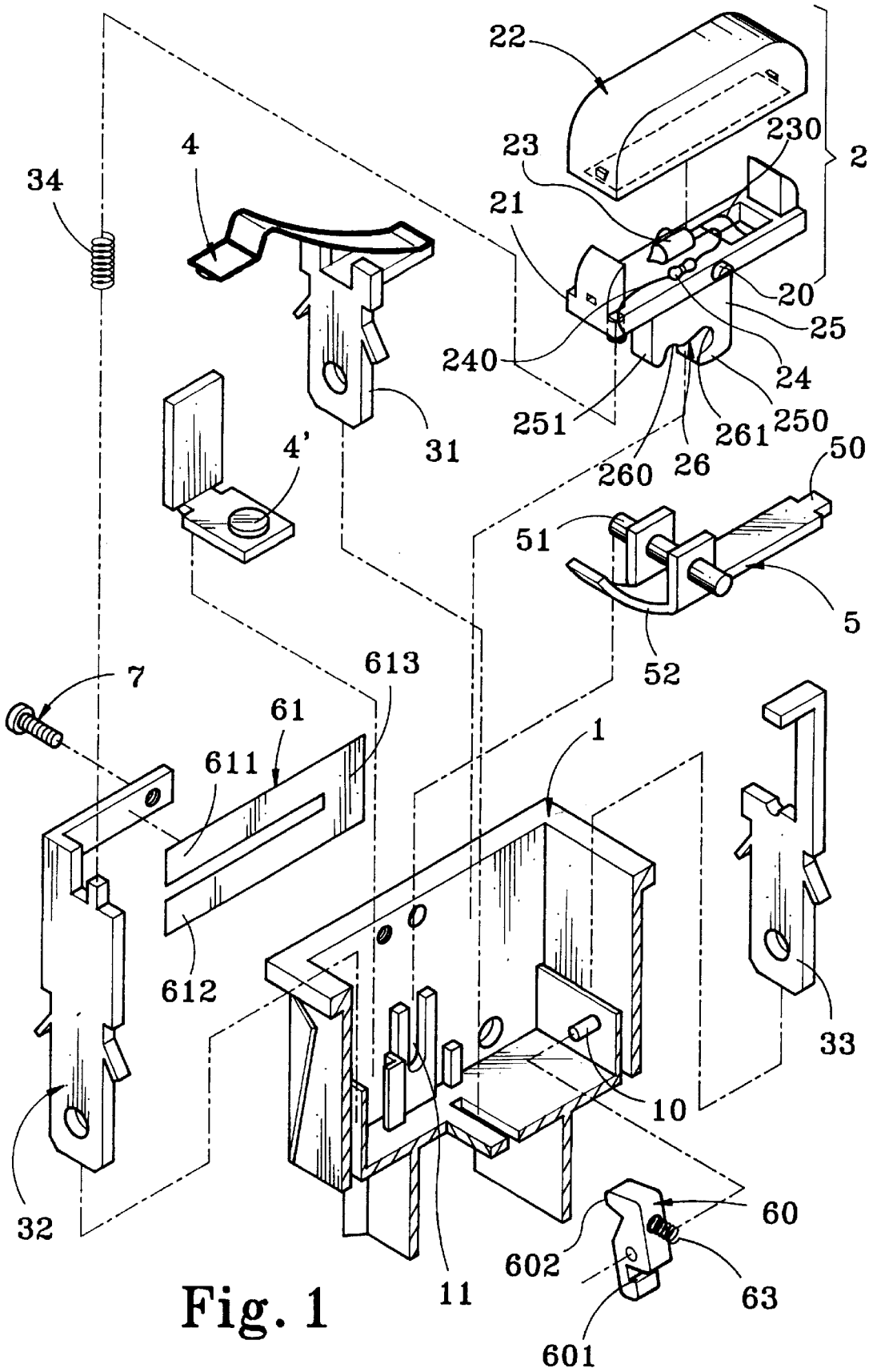
FIG. 1 is an exploded view of an overload protective circuit breaker switch according to the present invention.
Figure 2:
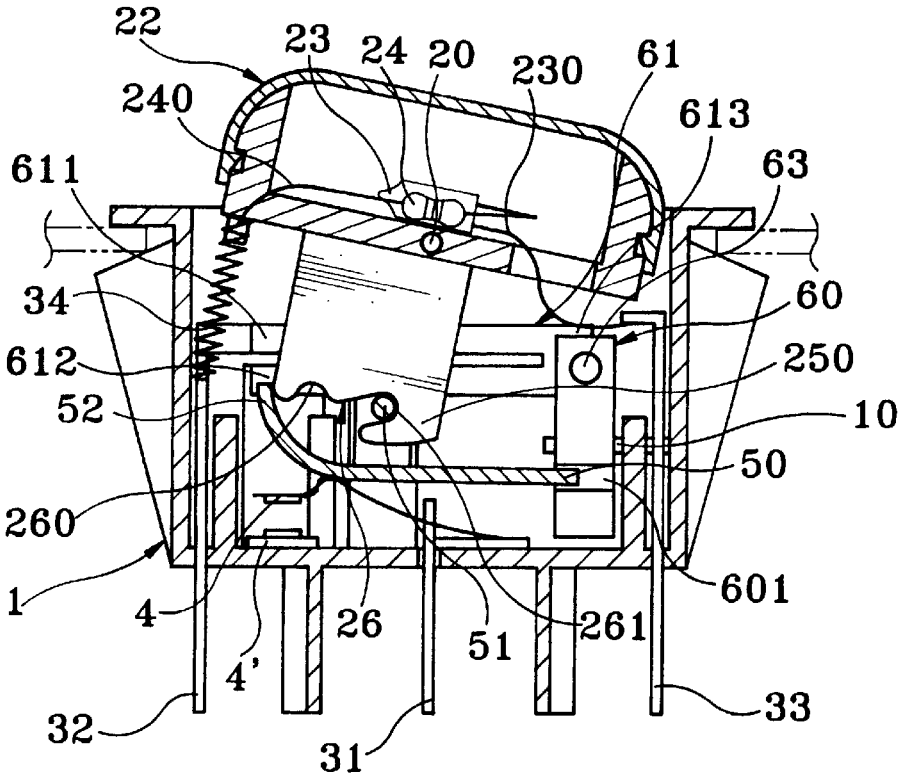
FIG. 2 is a sectional view of the present invention, showing circuit breaker switch retained at the open circuit status.

Referring to FIGS. 1 and 2, an overload protective circuit breaker switch in accordance with the present invention comprises an electrically insulative housing 1, an actuator 2 pivoted to the housing 1, a first fixed contact 31 and a second fixed contact 32 and a third fixed contact 33 adapted to be connected to power supply or the power supply circuit of an electric appliance, a first movable contact 4 and a second movable contact 4' adapted to form with the first fixed contact 31 and the second fixed contact 32 a normal open contact, a lever 5 adapted to move the movable contacts 4;4' to close the circuit, and a release mechanism adapted to return the lever 5 to the normal open contact status upon an overload.

The actuator 2 comprises an oscillating member 21 having a pivot 20 pivoted to the housing 1 on the inside, a light penetrative cap 22 detachably covered on the oscillating member 21, a bulb 23 mounted on the oscillating member 21, a resistor 24 connected in series to the bulb 23, a metal spring 34, and a trigger 25. The metal spring 34 imparts pressure to the oscillating member 21, causing the oscillating member 21 to be retained in the aforesaid normal open contact position. The resistor 24 has one end connected in series to the bulb 23, and an opposite end 240 connected to the second fixed contact 32 through the metal spring 34. The trigger 25 is fixedly connected to the oscillating member 21 at the bottom and moved with it between the actuating position and the non-actuating position, comprising an actuating face 26 constantly maintained in contact with the lever 5. The actuating face 26 comprises an actuating point 260 and a non-actuating point 261 respectively spaced from the pivot 20 at different distances. The distance between the pivot 20 and the actuating point 260 is greater than that between the pivot 20 and the non-actuating point 261. The actuating face 26 is a surface formed between the actuating point 260 and the non-actuating point 261.

The lever 5 comprises a bearing portion 50 at one end adapted to be moved with the lever 5 between a first bearing point and a second bearing point, a pressure portion 52 disposed at an opposite end and constantly maintained in contact with the movable contacts 4;4', and a resisting portion 51 disposed in contact with the actuating face 26 of the trigger 25 and reciprocated to move the first movable contact 4 between the first fixed contact 31 and the second fixed contact 32. The lever 5 shown in FIG. 1 is a strip-like element. The resisting portion 51 is shaped like a round rod having two opposite ends adapted to be reciprocated in a respective track 11 inside the housing 1.

The aforesaid release mechanism comprises a movable member 60 adapted to hold the bearing portion 50 of the lever 5 at the aforesaid first bearing point, a bimetal 61 linked to the movable member 60 and adapted to move the bearing portion 50 of the lever 5 to the aforesaid second bearing point. The movable member 60 is turned about a pivot pin 10 inside the housing 1, having a retaining hole 601 at its bottom end coupled to the bearing portion 50 to hold it in the first bearing point. A return spring 63 is provided to impart a pressure to the top end 602 of the movable member 60, causing the retaining hole 601 to be constantly maintained in engagement with the bearing portion 50 of the lever 5. The bimetal 61 comprises a first fixed end 611 fixed to the second fixed contact 32, and a fixed end 612 fixed to the second movable contact 4', and a free end 613. The free end 613 pushes the top end 602 of the movable member 60 against the spring force of the return spring 63 when the bimetal 61 is heated to deform.

Figure 3:
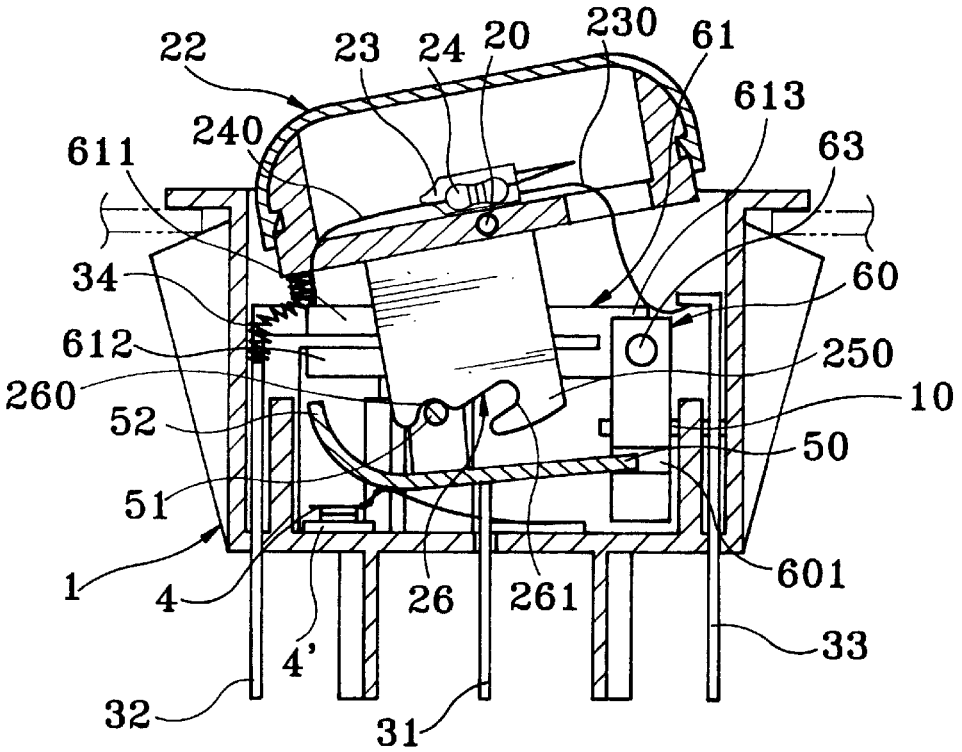
FIG. 3 is another sectional view of the present invention, showing the circuit breaker switch retained at the close circuit status.

Referring to FIG. 2, when the electric appliance is not started, the resisting portion 51 of the lever 5 is disposed at the non-actuating point 261 and lifted by the nose 250 of the trigger 25, the bearing portion 50 is retained by the retaining hole 601 of the movable member 60 at the first bearing point, the first movable contact 4 and the second movable contact 4' are not in contact with each other, therefore the fixed contact 31 and the second fixed contact 32 form an open circuit, no electric current is allowed to flow through the second movable contact 4' to the bimetal 61. On the contrary, when the user pushes the actuator 2 to the position shown in FIG. 3, the resisting portion 51 of the lever 5 is moved along the actuating face 26 to the actuating point 260. When the resisting portion 51 reaches the actuating point 260, the pressure portion 52 of the lever 5 is forced to push the first movable contact 4 toward the second movable contact 4', thereby causing the first movable contact 4 contact the second movable contact 4'. When the first movable contact 4 and the second movable contact 4' are disposed in contact with each other, the first fixed contact 31 and the second fixed contact 32 form with the bimetal 61 a close circuit, thereby causing the electric appliance to be electrically connected, and at the same time the other terminal 230 of the bulb 23 is disposed in contact with the third fixed contact 33 to close the circuit. When the terminal 230 is disposed in contact with the third fixed contact 33, electric power supply is connected to the bulb 23, causing it to be turned on.

Figure 4:
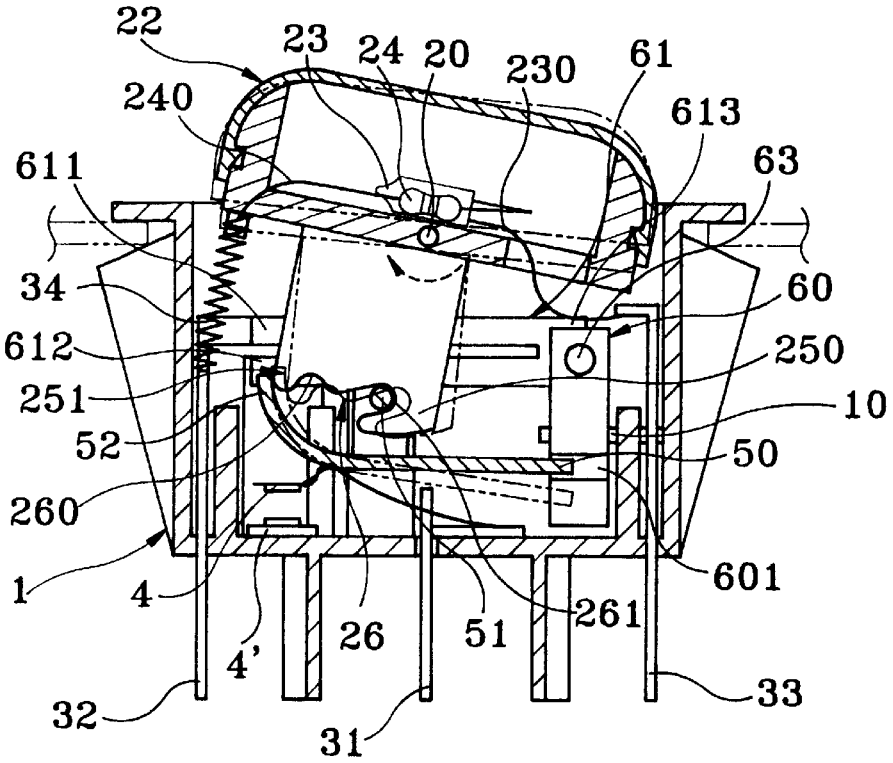
FIG. 4 is still another sectional view of the present invention, showing an overload occurred, the bearing portion of the lever moved to the second bearing point, the circuit breaker switch retained at the open circuit status.
Figure 6:
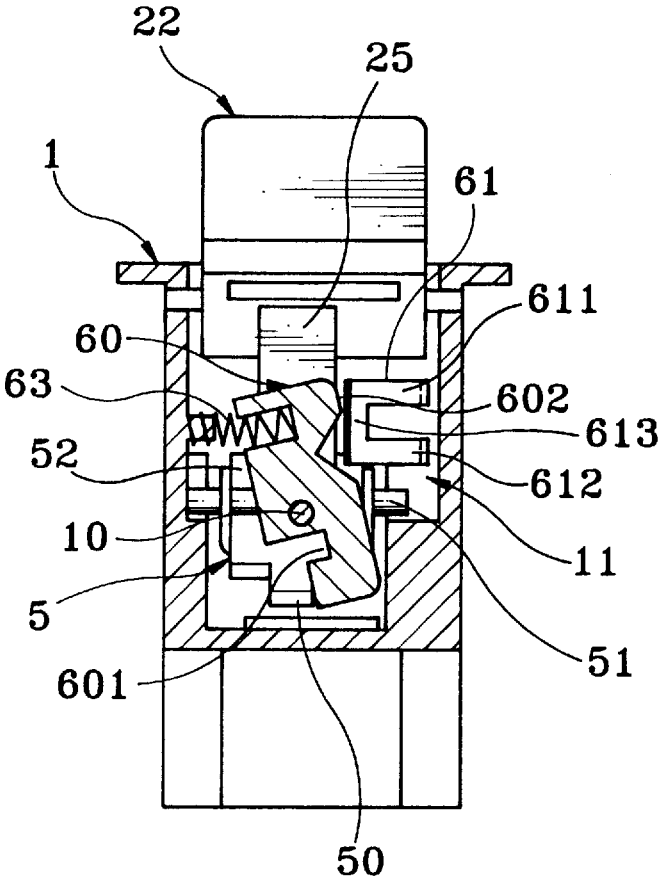
FIG. 6 is still another sectional view of the present invention, showing the operation of the release mechanism.

Referring to FIG. 4, when an overload occurs, the bimetal 61 is heated to curve toward the movable member 60, causing its free end 613 to push the top end 602 of the movable member 60 against the return spring 63. When the top end 602 of the movable member 60 is forced against the return spring 63, the retaining hole 601 is moved in the reversed direction and disengaged from the bearing portion 50 of the lever 5 (see FIG. 6). When the retaining hole 601 of the movable member 60 is disengaged from the bearing portion 50 of the lever 5, the bearing portion 50 of the lever 5 is immediately forced downwards from the first bearing point to the second bearing point by the return spring force of the first movable contact 4, and at the same time the actuator 2 is moved back to the position shown in FIG. 2 by the spring force of the spring 34, the movable contacts 4;4' are separated from each other, and the lever 5 is moved upwards.

The pressure portion 52 of the lever 5 curves smoothly upwards so that when the trigger 25 is returned to the position shown in FIG. 2 during the up stroke of the lever 5, the front end 251 of the trigger 25 pushes the curved pressure portion 52 of the lever 5, causing the bearing portion 50 of the lever 5 to be forced back into engagement with the retaining hole 601 of the movable member 60 again.

Figure 5:
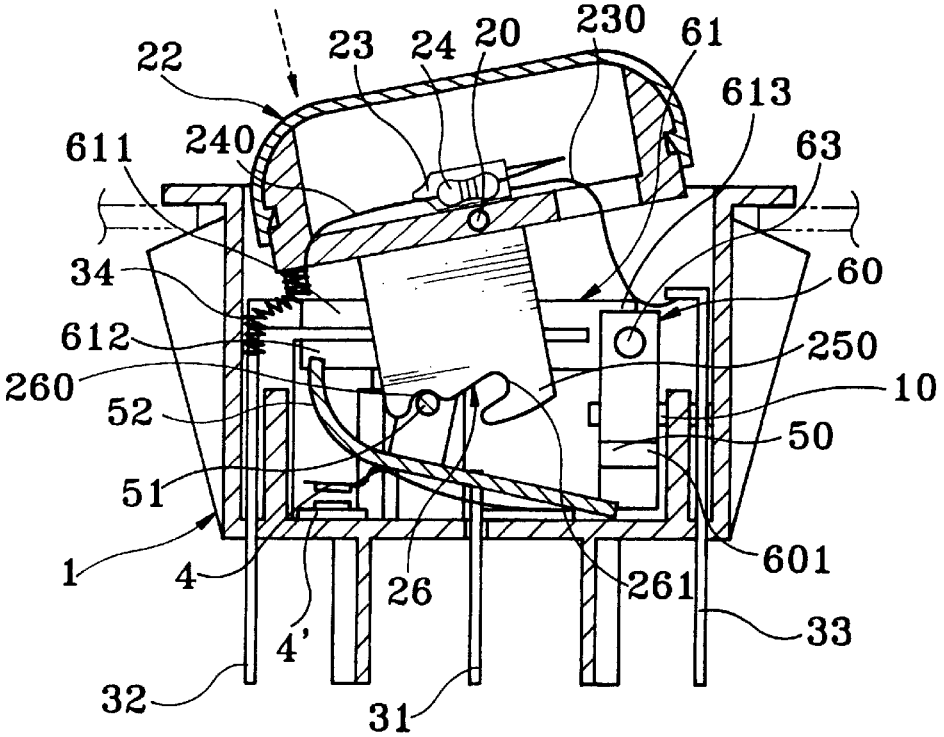
FIG. 5 is still another sectional view of the present invention, showing the actuator depressed upon an overload, the lever released, the circuit breaker switch retained at the open circuit status.

Referring to FIG. 5, when an overload occurs as the actuator 2 is depressed by the user, the first movable contact 4 is allowed to spring upwards and to separate from the second movable contact 4' (because the bearing portion 50 of the lever 5 is released to the lower second bearing point. Therefore, even the actuator 2 is set in the close circuit contact status, the movable member 60 can still release the lever 5 to the second bearing point, causing the lever 5 to release the movable contacts 4;4' to the normal open contact status, i.e., the circuit breaker switch automatically cuts off power supply whenever an overload happens.

Figure 7:
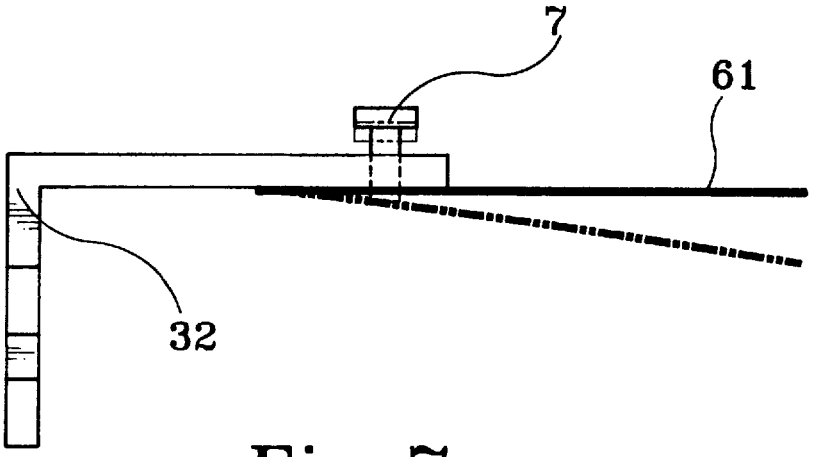
FIG. 7 is schematic drawing showing the adjustment of the bimetal according to the present invention.

Referring to FIG. 7 and FIG. 1 again, a fine adjustment element 7 is mounted on the second fixed contact 32, and can be moved to push the bimetal 61. The fine adjustment element 7 can be an adjustment screw stopped against a part of the bimetal 61 between the first fixed end 611 and the free end 613. By means of adjusting the fine adjustment element 7, the moving range of the free end 613 of the bimetal 61 as well as the length of time in which the movable member 60 is moved to release the bearing portion 50 of the lever 5 are relatively adjusted. Therefore, the rated load of the electric appliance can be relatively adjusted. Furthermore, the retaining hole the retaining hole 601 must have a limited depth. If the retaining hole 601 is made excessively deep, the movable member 60 will be unable to release the bearing portion 50 of the lever 5 in time, and the response speed of the circuit breaker switch will be affected.

While only one embodiment of the present invention has been shown and described, it will be understood that various modifications and changes could be made thereunto without departing from the spirit and scope of the invention disclosed.

We claim:

1. An overload protective circuit breaker switch comprising:

a first fixed contact and a second fixed contact adapted to connect an electric appliance to a power supply;

a movable contact adapted to form with said first fixed contact and said second fixed contact a normal open contact;

an actuator controlled by the user to turn about an axis wherein said actuator comprises an oscillating member turned about the axis, a light penetrative cap detachably covering said oscillating member, a spring adapted to hold said oscillating member in a normal open contact position, a trigger fixedly connected to a bottom side of said oscillating member and moving with said oscillating member between an actuating position and a non-actuating position, said trigger comprising an actuating face having an actuating point and a non-actuating point respectively spaced from said axis at different distances, the distance between said axis and said actuating point being greater than the distance between said axis and said non-actuating point;

a lever coupled to and turned with said actuator wherein said actuating face is constantly maintained in contact with said lever, said lever being turned about a first bearing point, when the overload protective circuit breaker switch is not at an overload status, to move said movable contact between a normal open contact position in which said movable contact form with said first fixed contact and said second fixed contact a normal open contact, and a normal close contact position in which said movable contact form with said first fixed contact and said second fixed contact a normal close contact; and a release mechanism adapted to move said lever, said release mechanism releasing said lever from said first bearing point to a second bearing point upon an overload, causing said lever to release said movable contact and to let said movable contact return to the normal open contact status.

2. The overload protective circuit breaker switch of claim 1 wherein said lever comprises a bearing portion at one end adapted to be moved with said lever between a first bearing point and a second bearing point, a pressure portion disposed at an opposite end and constantly maintained in contact with said movable contact, and a resisting portion disposed in contact with said actuating face of the trigger and reciprocated to move said movable contact between said first fixed contact and said second fixed contact to form said normal open contact or said normal close contact.

3. The overload protective circuit breaker switch of claim 2 wherein said release mechanism comprises a movable member adapted to hold said bearing portion of said lever at said first bearing point, a bimetal linked to said movable member and adapted to move said bearing portion of said lever to said second bearing point.

4. The overload protective circuit breaker switch of claim 3 wherein said movable member is turned about a fixed pivot pin, having a retaining hole at a bottom end thereof coupled to said bearing portion of said lever to hold it in said first bearing point, a top end supported on a return spring, said return spring imparting a pressure to the top end of said movable member, causing the retaining hole of said movable member to be constantly maintained in engagement with said bearing portion of said lever; said bimetal comprising a first fixed end fixed to said second fixed contact, a second fixed end fixed to said movable contact, and a free end, said free end pushing the top end of said movable member against the spring force of said return spring when said bimetal is heated to deform.

* * * * *